US006067666A

United States Patent [19]

Dixon

[11] Patent Number: 6,067,666

[45] Date of Patent: May 30, 2000

[54] TOILET SEAT LID FOR ACCOMMODATING A CHILD

[76] Inventor: Gerald Eugene Dixon, 16147 SE. Sunflower Rd., Leon, Kans. 67074

[21] Appl. No.: 09/196,555

[22] Filed: Nov. 20, 1998

[51] Int. Cl.[7] ..... A47K 13/06

[52] U.S. Cl. ..... 4/239; 4/254

[58] Field of Search ..... 4/234, 235, 237, 4/239, 242.1, 254

[56] References Cited

U.S. PATENT DOCUMENTS

| | | | |
|---|---|---|---|
| 806,176 | 12/1905 | Oakley | 4/254 X |
| 1,950,016 | 3/1934 | Zuckerman | 4/239 |
| 2,454,199 | 11/1948 | Perrin | 4/239 |

FOREIGN PATENT DOCUMENTS

| | | | |
|---|---|---|---|
| 614712 | 12/1948 | United Kingdom | 4/239 |

*Primary Examiner*—Robert M. Fetsuga
*Attorney, Agent, or Firm*—Kenneth Jack; Davis & Jack LLC

[57] ABSTRACT

A child accommodating device for attachment to a toilet, the device comprising a toilet seat lid, the toilet seat lid having an upper surface, a lower surface, a right side, and a left side, the toilet seat lid having a child accommodating aperture extending therethrough from the upper surface to the lower surface, the child accommodating aperture being positioned between the right and left sides of the toilet seat lid; a right plate, the right plate having a lower surface and a right side, the right side of right plate being pivotally attached to the toilet seat lid so that the right plate may pivotally move from a first position wherein the lower surface of the right plate overlies the upper surface of toilet seat lid to a second position wherein the lower surface of the right plate faces substantially leftwardly, the right plate being positioned so that the right plate partially covers the child accommodating aperture while in the first position; and a left plate, the left plate having a lower surface and a left side, the left side of the left plate being pivotally attached to the toilet seat lid so that the left plate may pivotally move from a first position wherein the lower surface of the left plate overlies the upper surface of the toilet seat lid to a second position wherein the lower surface of the left plate faces substantially rightwardly, the left plate being positioned so that the left plate partially covers the child accommodating aperture while in the first position.

4 Claims, 7 Drawing Sheets

TOILET SEAT LID FOR ACCOMMODATING A CHILD

FIELD OF THE INVENTION

This invention relates to apparatus and mechanisms for adapting common adult sized toilets for use by small children. More particularly, this invention relates to toilet seat lids having such adaptations for use by such children.

BACKGROUND OF THE INVENTION

Three basic obstacles prevent small children from utilizing adult sized toilets. First, the aperture within an adult sized toilet seat typically is too large for utilization by a small child; second, the seat elevation of a common adult sized toilet typically is too high for a small child to conveniently seat himself or herself thereon; and third, an adult sized toilet typically has no side handles or rails for protecting small children seated thereon from falls.

A known approach to solving the first of the problems outlined above is to cut or form a smaller child accommodating aperture within a common toilet seat lid, such lid being of the type typically covering and overlying an adult sized toilet seat, such modified toilet seat lid commonly being covered by a second toilet seat lid pivotally attached to the adapted toilet seat lid. While such adaptations solve the singular problem of excess aperture size of an adult sized toilet seat, such adaptation offers children no assistance in seating themselves upon such a toilet seat, and such adaptation offers no protection of such children from falls from such toilet seat.

The instant invention solves all three of the problems described above by providing a modified second toilet seat lid, the modified second toilet seat lid including pivoting plates which provide protection from falling, and alternately provide a step for ease of mounting.

PRIOR ART PATENTS

U.S. Pat. No. Re 32,807 reissued Dec. 27, 1988, to Adams discloses a toilet seat lid having a child accommodating aperture therethrough.

U.S. Pat. No. 2,820,696 issued Jan. 28, 1958, to Wedge discloses a toilet seat lid having nested therein a child accommodating toilet seat.

U.S. Pat. No. 426,287 issued Apr. 22, 1990, to Larkin discloses a toilet seat lid having a child accommodating toilet seat nested therein.

U.S. Pat. No. 1,739,001 issued Dec. 10, 1929, to Justus discloses a toilet seat having a child accommodating aperture therethrough.

U.S. Pat. No. 2,219,643 issued Oct. 29, 1940, to Zaio discloses a child accommodating toilet seat.

U.S. Pat. No. 2,434,889 issued Jan. 20, 1948, to Sacia discloses a toilet seat lid having a child accommodating aperture therethrough.

U.S. Pat. No. 2,461,160 issued Feb. 8, 1949, to Joyce discloses a child accommodating toilet seat.

U.S. Pat. No. 2,494,813 issued Jan. 17, 1950, to Hughes discloses a child accommodating toilet seat.

U.S. Pat. No. 2,721,531 issued Oct. 25, 1955, to Findley, Jr., discloses a child accommodating toilet seat.

U.S. Pat. No. 2,808,874 issued Oct. 8, 1957, to Liebling discloses a child accommodating toilet seat.

U.S. Pat. No. 3,609,775 issued Oct. 5, 1971, to Leiter discloses a child accommodating toilet seat.

None of the above disclosed patents teach, disclose or describe the novel, inventive, useful and unique aspects, elements and features of the present inventive child accommodating toilet seat lid.

BRIEF SUMMARY OF THE INVENTION

The instant inventive child accommodating toilet seat lid preferably comprises an oval base having a child accommodating aperture therethrough. Preferably, the child accommodating aperture is centrally located, extending vertically through the oval base while such base is horizontally oriented. Also, preferably, the child accommodating aperture is elliptical in shape, having a lateral width between six and eight inches and having a longitudinal length between 6½ and 8½ inches.

Left and right cover plates are preferably hingedly attached to the left and right sides of the oval base, the left and right cover plates being capable of pivotal motion from first positions wherein the left and right cover plates either partially cover or totally cover the child accommodating aperture, to second positions wherein the left and right cover plates respectively extend upwardly and outwardly from the left and right sides of the oval base. While the left and right cover plates are in their first positions, the left and right cover plates perform the function of covering the child accommodating aperture. While the left and right cover plates are in their second positions, they function as a pair of handles or rails allowing a child seated upon the child accommodating toilet seat to stabilize himself or herself through hand pressure upon the upwardly facing surfaces of the left and right cover plates.

Preferably, the left and right cover plates are fabricated in a plastic injection molding process so that hinges interlinking the left and right cover plates with the oval base are formed as integral parts thereof. Particularly, it is preferable that the pivotal junctures of the left and right cover plates and the oval base be molded to form the eyed devises of pin and clevis joints. Such eyed clevises are preferably pivotally interlinked by plastic pins or corrosion resistant stainless steel or brass pins.

In use, the inventive child accommodating toilet seat lid will typically be alternately be positionable between a horizontal position and a substantially vertical position, leaning against a toilet tank; just as common toilet seat lids are pivotally positionable. In order to keep the left and right cover plates in place while pivotally moving between such positions, it is preferable that a removable attaching means be applied thereto. While snaps or latches may suitably be used to removably attach the left and right cover plates to the upper surface of the oval base, it is preferable that paired strip magnets and strips of magnetic stainless steel be utilized. Through utilization of such magnets and magnetic stainless steel strips, the left and right cover plates are caused to remain in their first inwardly folded positions while the child accommodating toilet seat lid is pivotally raised and lowered. The left and right cover plates may be easily pulled away from their magnetic attachments through application of a manual pulling force applied by a child.

Preferably, the pivotal junctures of the left and right cover plates and the oval base are further molded to form a pair of pivot stops, such pivot stops functioning to restrict outward pivotal motion of the left and right cover plates. While the cover plates are in their second positions, further pivotal motion thereof is restricted by the stops to motion toward their first positions. Thus, while a child is utilizing the child accommodating toilet seat lid, with the left and right cover plates at either side, such plates are restricted from pivotally moving laterally away from the child, providing consistent stabilizing support for the child.

In an alternate configuration of the child accommodating toilet seat lid, a step suspending plate is pivotally attached to the forward end of the oval base. Preferably, the step suspension plate is capable of pivotal motion from a first position wherein the step suspension plate overlies the upper surface of the oval base, at least partially covering the child accommodating aperture, to a second position wherein the step suspension plate extends substantially perpendicularly downward from the forward end of the oval base. In order to accommodate positioning of the step suspension plate in its first position, it is preferable that the radial length of the left and right cover plates be shortened, allowing both the left and right cover plates and the step suspension plate, when pivotally folded to their first positions, to perform the function of covering the child accommodating aperture. Preferably, a step plate is pivotally attached to the step suspension plate so that while the step suspension plate is in its second position, the step plate extends substantially perpendicularly forward from the step suspension plate. Preferably, the step plate is capable of upward pivotal motion from such perpendicularly oriented position, to come into contact with the forwardly facing surface of the step suspension plate. As with the left and right cover plates, pivotal motion of the step plate is preferably restricted by a pivot stop. Also, as with the left and right cover plates, the step plate is preferably removably attached in such upwardly folded position by means of a strip magnet and strip magnetic stainless steel. Similarly, while the step suspension plate is in its first position, it is preferably removeably attached by means of a strip magnet and a strip of magnetic stainless steel.

Accordingly, it is an object of the present invention to provide a toilet seat having a reduced size child accommodating aperture therethrough.

It is further object of the present invention to provide such a toilet seat having paired pivotally attached child accommodating aperture covers, such covers serving dual functions of covering the child accommodating aperture, and providing railings for prevention of falls.

It is a further object of the present invention to provide such a toilet seat alternately including a pivotally extendable step capable of serving dual functions of assistance in mounting the toilet seat and covering the child accommodating aperture.

Other and further objects, benefits, and advantages of the present invention will become known to those skilled in the art upon review of the Detailed Description which follows, and upon review of the appended drawings.

DETAILED DESCRIPTION OF THE PREFERRED EMBODIMENT

Figure 1:
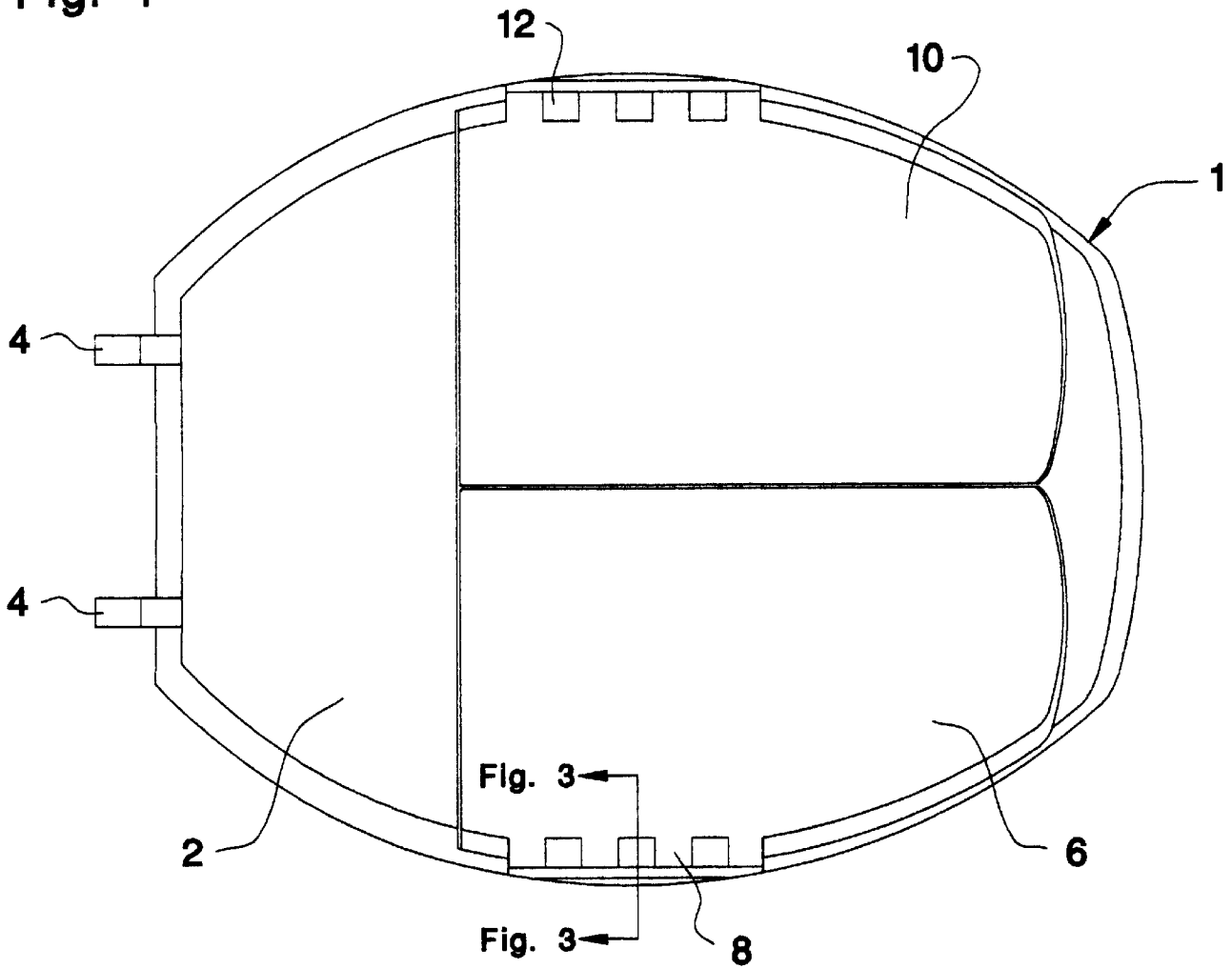
FIG. 1 is a plan view of the present inventive child accommodating toilet seat lid.

Referring now to the drawings, and in particular to FIG. 1, the present inventive child accommodating toilet seat lid is referred to generally by reference numeral 1. The child accommodating toilet seat lid 1 has a substantially oval base 2, the base 2 preferably being composed of injection molded plastic. The base 2 is preferably hingedly attachable to a common toilet by means of hinges 4 in a manner similar to that of common toilet seat lids.

A right cover plate 6 is preferably pivotally attached to the base 2 by means of a right hinge 8. Similarly, a left cover plate 10 is preferably pivotally attached to the base 2 by means of a left hinge 12. Like the base 2, the right and left cover plates 6 and 10 are preferably composed of injection molded plastic. Preferably, the right and left hinges 8 and 12 are formed in said injection molding process as homogeneous parts of the right cover plate 6, of the left cover plate 10, and of the base 2.

Figure 3:
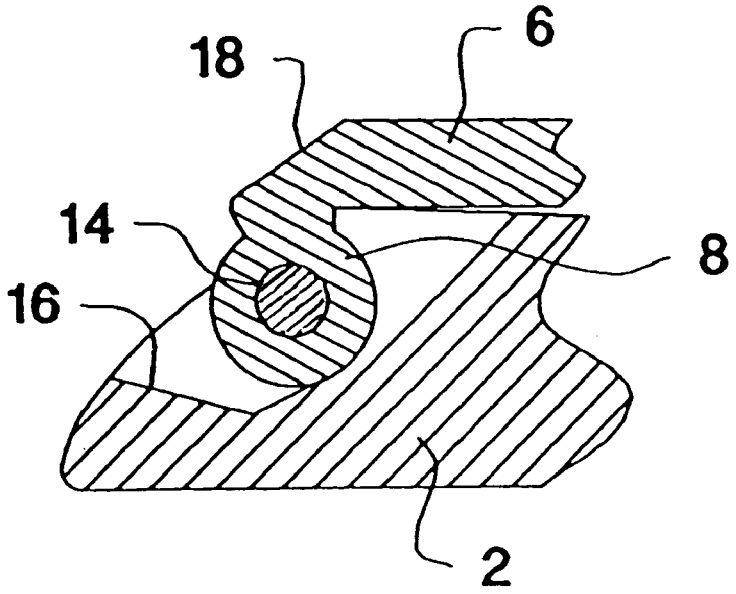
FIG. 3 is a partial sectional view of FIG. 1 as indicated in FIG. 1.

Referring simultaneously to FIGS. 1 and 3, the right hinge 8 has a swivel pin 14 extending axially therethrough, and the left hinge 12 similarly has an axially extending swivel pin (not shown) extending therethrough. The swivel pins preferably are composed of corrosion resistant plastic, stainless steel, or brass.

Figure 4:
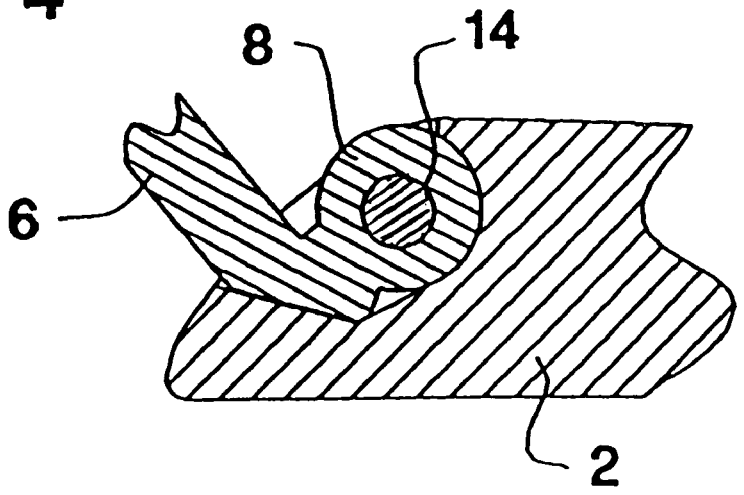
FIG. 4 is a partial sectional view of FIG. 2 as indicated in FIG. 2.

Referring simultaneously to FIGS. 1, 3 and 4, the right cover plate 6 is capable of pivotal motion about swivel pin 14 from the position depicted in FIG. 3 to the position depicted in FIG. 4. Such counter-clockwise rotation from the position depicted in FIG. 3 to the position depicted in FIG. 4 is stopped by pivot stops 16 and 18 which are preferably molded in the injection molding process as integral features of the base 2 and the right cover plate 6. The left cover plate 10 similarly has pivot stops (not shown) molded as an integral part thereof.

Figure 2:
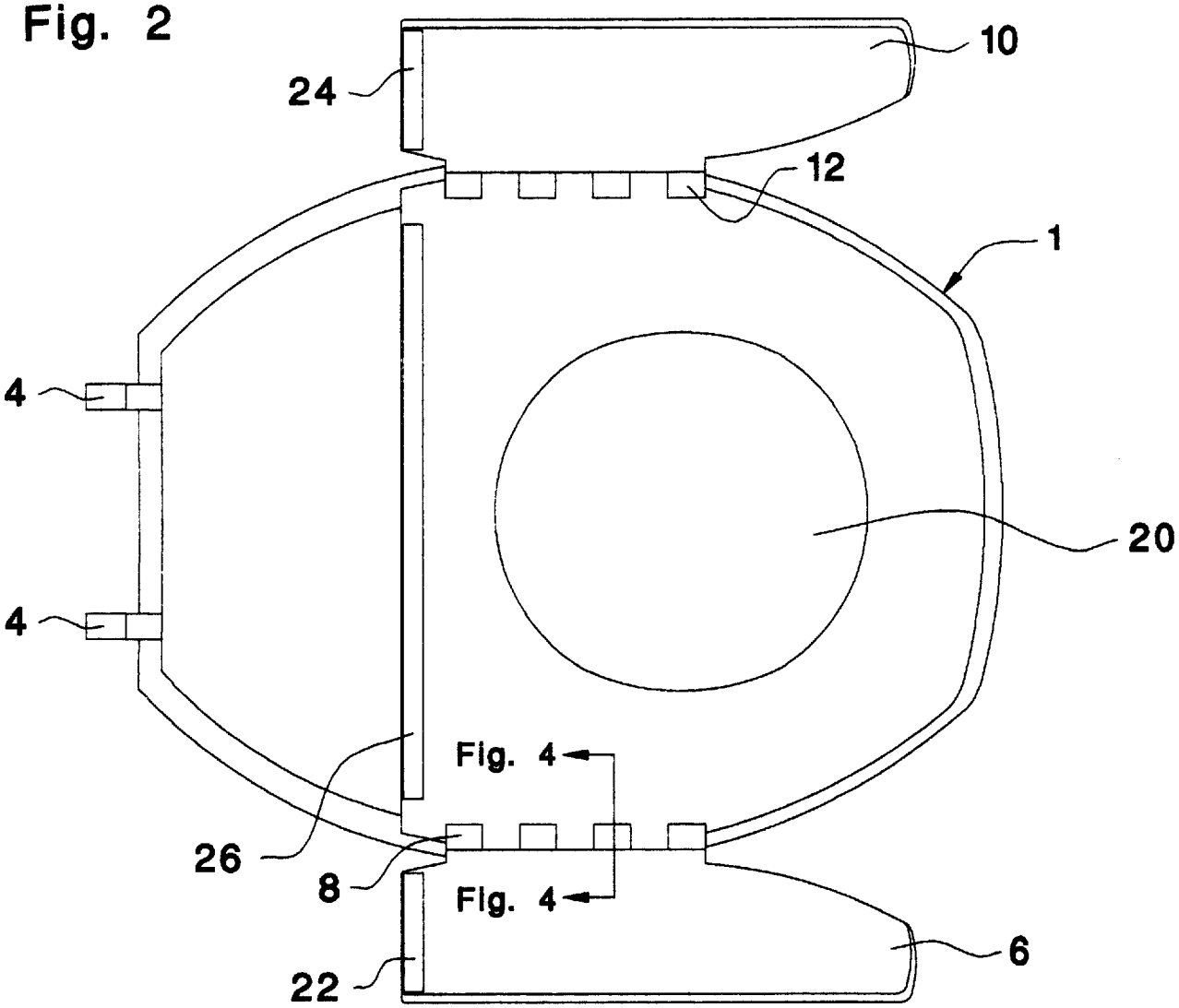
FIG. 2 is a second plan view of the child accommodating toilet seat lid, the view showing left and right cover plates in their raised position.

Referring to FIG. 2, depicting the left and right cover plates 10 and 6 in their opened and upwardly extended positions, a child accommodating aperture 20 is exposed for use by a child. A child seated upon the upper surface of the base 2, and over the child accommodating aperture 20, may rest his or her right hand upon the upwardly facing surfaces of the right cover plate 6, and may rest his or her left hand upon the upwardly facing surfaces of the left cover plate 10. With hands so positioned, a child utilizing the child accommodating toilet seat 1 may stabilize him or herself, preventing injurious falls.

Removable attaching means, preferably strip magnets 22 and 24 imbedded within the rearward edges of the left and right cover plates 10 and 6, and a magnetic stainless steel strip 26 imbedded within the base 2, are provided such strip 26 being positioned so that it underlies the magnet strips 22 and 24 when the left and right cover plates 10 and 6 are in their closed or inwardly folded positions. Through utilization of such magnet strips 22 and 24 and magnetic stainless steel strip 26, the left and right cover plates 10 and 6 are held in place, while the child accommodating toilet seat lid 1 is pivotally raised and lowered.

Figure 1A:
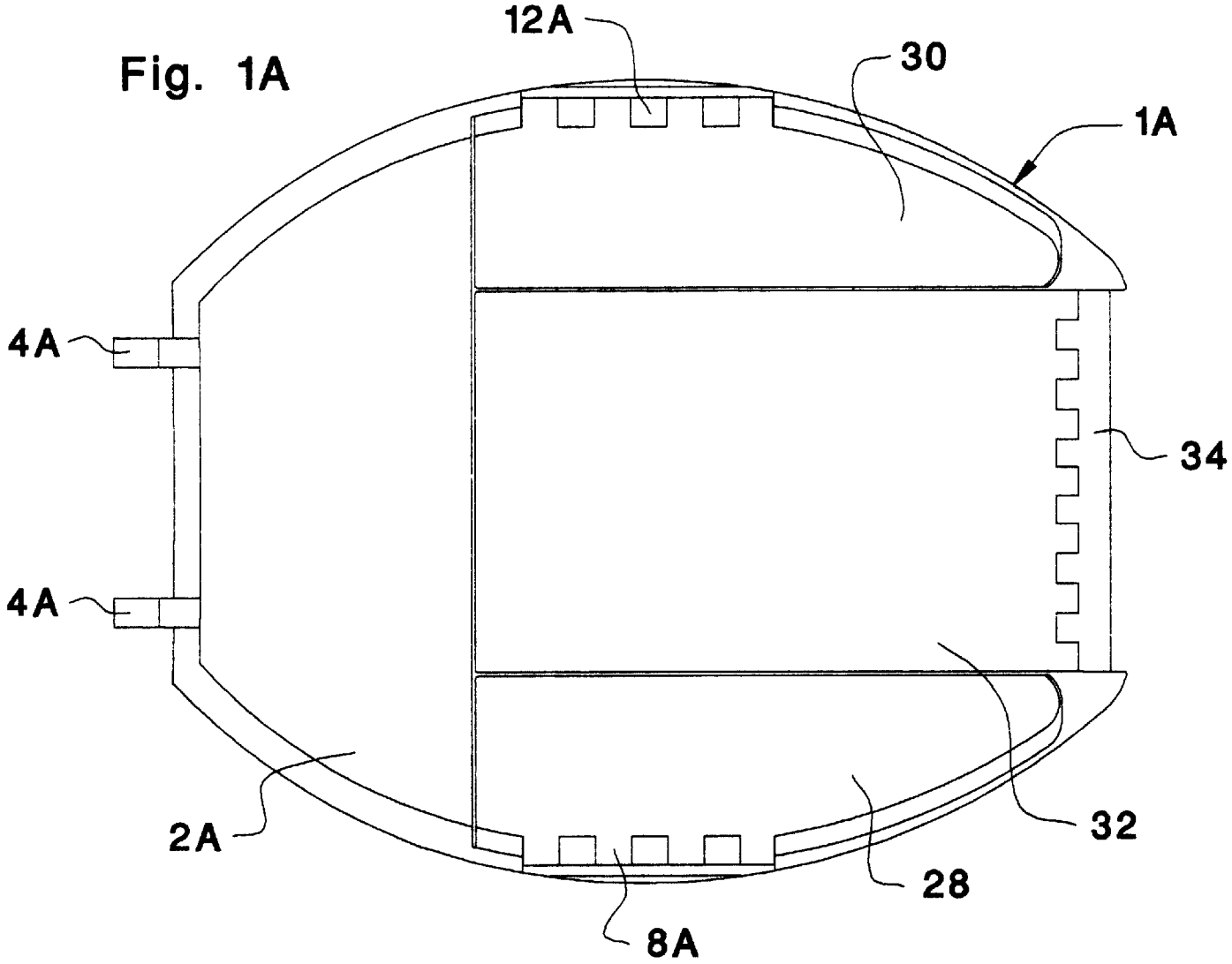
FIG. 1A is a plan view of an alternate configuration of the present inventive child accommodating toilet seat lid.

Referring to FIG. 1A, an alternately configured child accommodating toilet seat lid is referred generally by reference numeral 1A. Referring simultaneously to FIGS. 1 and 1A, the base 2A, hinges 4A, right hinge 8A, and left hinge 12A, are identical to elements having reference numerals 2, 4, 8 and 12 depicted in FIG. 1.

Referring further to FIGS. 1 and 1A, a right cover plate 28 and a left cover plate 30 have configurations similar to those of the left and right cover plates 10 and 6, with the exceptions that the radial dimensions of the left and right cover plates 30 and 28 are shorter than those of the left and right cover plates 10 and 6. Such shortening of the radial dimensions of the left and right cover plates 30 and 28 allows a step suspension plate 32 to be disposed between the left and right cover plates 30 and 28 when such plates are in their closed or folded position.

Figure 2A:
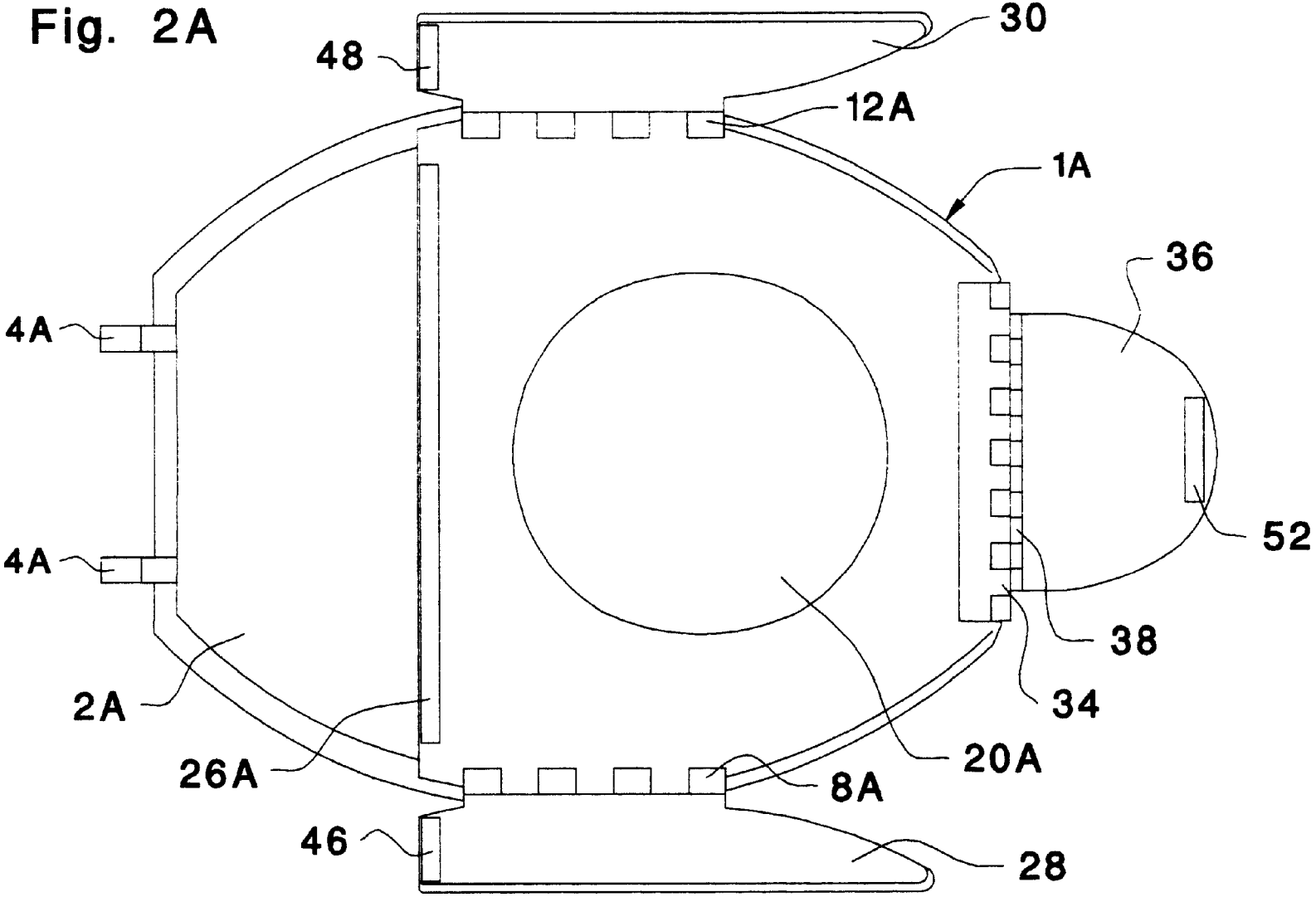
FIG. 2A is a plan view of the alternately configured child accommodating toilet seat lid depicted in FIG. 1A, the view of FIG. 2A showing left and right cover plates in their extended positions, and showing a plate in its extended position.
Figure 5:
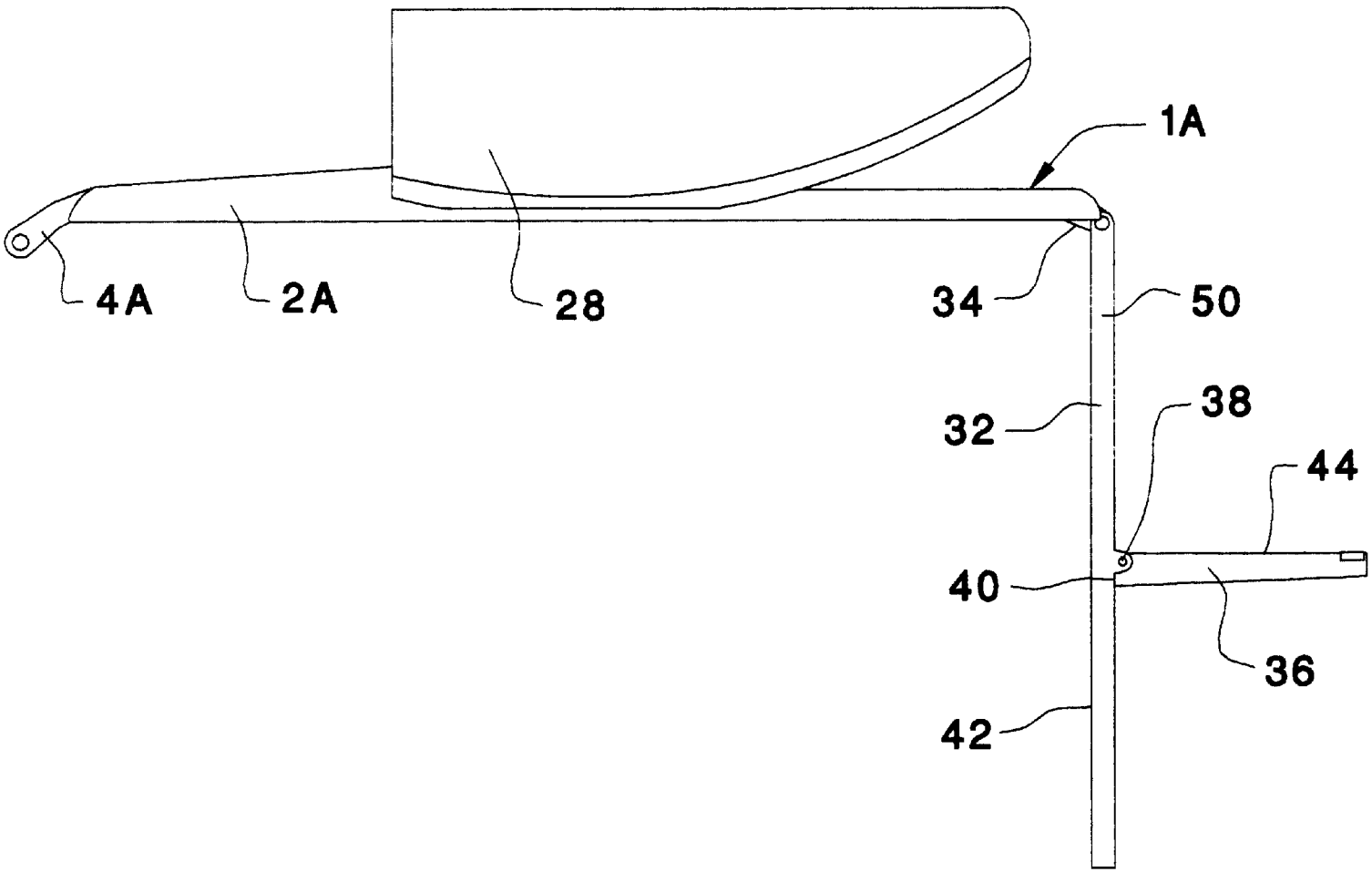
FIG. 5 is a side view of the alternately configured child accommodating toilet seat lid depicted in FIG. 2A.

Referring to FIG. 1A, the step suspension plate 32 preferably pivotally attached to the base 2A at its forward end by means of a hinge 34. Referring simultaneously to FIGS. 1A and 5, the step suspension plate 32 is capable of pivotal motion from a first position as depicted in FIG. 1A to a second position as depicted in FIG. 5. Referring simultaneously to FIGS. 2A and 5, a step plate 36 is pivotally attached to the step suspension plate 32 by means of a hinge 38. Referring to FIG. 5, a pivot stop 40 prevents the step plate 36 from pivotally moving past a perpendicular orientation with respect to the step suspension plate 32. In use of the step plate 36, the rearwardly facing surface 42 of the step suspension plate 32 biases against a forwardly facing surface of a toilet (not shown) upon which the child accommodating toilet seat lid 1 is mounted, while a child steps upon the upwardly facing surface 44 of the step plate 36.

Figure 6:
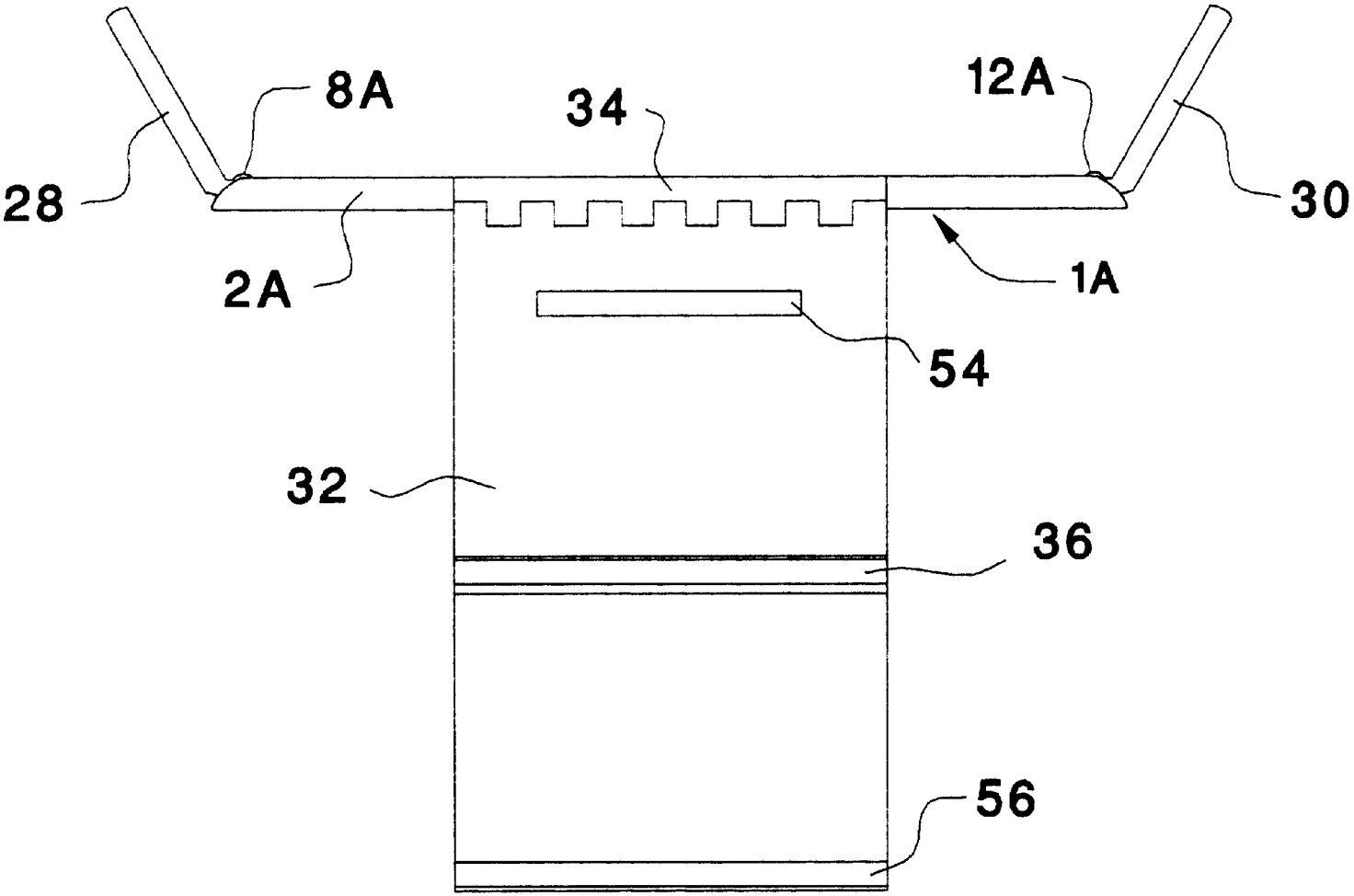
FIG. 6 is a front view of the alternately configured child accommodating toilet seat lid depicted in FIG. 2A.

Referring simultaneously to FIGS. 2 and 2A, the removable attaching means magnetic stainless steel strip 26A and the child accommodating aperture 20 are identical to the magnetic stainless strip 26 and the child accommodating aperture 20. Removable attaching means, preferably magnets 46 and 48 function in the same manner as magnets 22 and 24. Referring simultaneously to FIGS. 2A, 5 and 6, upon upward or counter-clockwise rotation of the step plate 36, the upwardly facing surface 44 of the step plate 36 comes into contact with the forwardly facing surface 50 of the step suspension plate 32. Upon such contact, a removable attaching means, preferably a magnet 52 comes into contact with a magnetic stainless steel strip 54. Such magnetic contact removeably holds the step plate 36 in its upwardly folded position.

Referring simultaneously to FIGS. 1A, 2A and 6, upon pivotal motion of the step suspension plate 32 from the position depicted in FIG. 6, to the position depicted in 1A, a magnet 56 contacts the magnetic stainless steel strip 26A to removeably hold the step suspension plate in its folded position.

While the principles of the invention have been made clear in the above illustrative embodiment, those skilled in the art may make modifications in the structure, arrangement, portions and components of the invention without departing from those principles. Accordingly, it is intended that the description and drawings be interpreted as illustrative and not in the limiting sense, and that the invention be given a scope commensurate with the appended claims.

I claim:

1. A child accommodating device for attachment to a toilet, the child accommodating device comprising:

(a) a toilet seat lid, the toilet seat lid having an upper surface, a lower surface, a right side, and a left side, the toilet seat lid having a child accommodating aperture extending therethrough from the upper surface to the lower surface, the child accommodating aperture being positioned between the right and left sides of the toilet seat lid;

(b) a right plate, the right plate having a lower surface and a right side, the right side of right plate being pivotally attached to the toilet seat lid so that the right plate may pivotally move from a first position wherein the lower surface of the right plate overlies the upper surface of toilet seat lid, to a second position wherein the lower surface of the right plate faces substantially leftwardly, the right plate being positioned so that the right plate partially covers the child accommodating aperture while the right plate is in the first position; and, (c) a left plate, the left plate having a lower surface and a left side, the left side of the left plate being pivotally attached to the toilet seat lid so that the left plate may pivotally move from a first position wherein the lower surface of the left plate overlies the upper surface of the toilet seat lid to a second position wherein the lower surface of the left plate faces substantially rightwardly, the left plate being positioned so that the left plate partially covers the child accommodating aperture while the left plate is in the first position; the pivotal attachments of the left and right plates respectively comprising left and right hinges, the left hinge interlinking the left side of the left plate with the left side of the toilet seat lid, and the right hinge interlinking the right side of the right plate with the right side of the toilet seat lid; the left and right sides of the toilet seat lid and of the left and right plates respectively forming left and right pivot stops restricting pivotal motion of the left and right plates so that while the left and right plates are in their second positions, they may pivotally move therefrom only toward their first positions; and further comprising removable attaching means fixedly attached to the upper surface of the toilet seat lid and to the lower surfaces of the left and right plates, the removable attaching means further interlinking the left and right plates with the toilet seat lid while the left and right plates are in their first positions; the removable attaching means comprising magnets.

2. The child accommodating device of claim 1, wherein the toilet seat lid has a rear edge, and further comprising a pair of hinges fixedly attached to the rear edge of the toilet seat lid.

3. The child accommodating device of claim 2, wherein the toilet seat lid, the left plate and the right plate are fabricated utilizing plastic injection molding processes, and wherein the left and right hinges comprise clevis joints fabricated in the injection molding processes.

4. A child accommodating device for attachment to a toilet, the child accommodating device comprising:

(a) a toilet seat lid, the toilet seat lid having an upper surface, a lower surface, a right side, and a left side, the toilet seat lid having a child accommodating aperture extending therethrough from the upper surface to the lower surface, the child accommodating aperture being positioned between the right and left sides of the toilet seat lid;

(b) a right plate, the right plate having a lower surface and a right side, the right side of right plate being pivotally attached to the toilet seat lid so that the right plate may pivotally move from a first position wherein the lower surface of the right plate overlies the upper surface of toilet seat lid, to a second position wherein the lower surface of the right plate faces substantially leftwardly, the right plate being positioned so that the right plate partially covers the child accommodating aperture while the right plate is in the first position; and, (c) a left plate, the left plate having a lower surface and a left side, the left side of the left plate being pivotally attached to the toilet seat lid so that the left plate may pivotally move from a first position wherein the lower surface of the left plate overlies the upper surface of the toilet seat lid to a second position wherein the lower surface of the left plate faces substantially rightwardly, the left plate being positioned so that the left plate partially covers the child accommodating aperture while the left plate is in the first position; the toilet seat lid having a front edge; further comprising a step suspension plate, the step suspension plate having a lower surface and a front edge, the front edge of the step suspension plate being pivotally attached to the front edge of the toilet seat lid so that the step suspension plate may pivot from a first position wherein the lower surface of step suspension plate overlies the upper surface of the toilet seat lid and at least partially covers the child accommodating aperture, to a second position wherein the lower surface of the step suspension plate faces forwardly; further comprising a step plate having a rear edge and an upper surface, the rear edge of step plate being pivotally attached to the lower surface of the step suspension plate so that the step plate may pivot from a first position wherein the step plate's upper surface underlies the lower surface of the step suspension plate, to a second position wherein the step plate extends outwardly from the step suspension plate; the pivotal attachments of the left and right plates respectively comprising left and right hinges, the left hinge interlinking the left side of the left plate with the left side of the toilet seat lid, the right hinge interlinking the right side of the right plate with the right side of the toilet seat lid; the pivotal attachments of the step suspension plate and the step plate comprising a second pair of hinges; the left and right sides of the toilet seat lid and of the left and right plates respectively forming left and right pivot stops restricting pivotal motion of the left and right plates so that, while the left and right plates are in their second positions, they may pivotally move therefrom only toward their first positions; the rear edge of the step plate forming a third pivot stop restricting pivotal motion of the step plate so that while the step plate is in its second position, it may pivotally move therefrom only toward its first position; further comprising first removable attaching means fixedly attached to the upper surface of the toilet seat lid and to the lower surfaces of the left and right plates, the first removable attaching means further interlinking the left and right plates with the toilet seat lid while the left and right plates are in their first positions; further comprising second removable attaching means fixedly attached to the upper surface of the toilet seat lid and to the lower surface of the step suspension plate, the second removable attaching means further interlinking the step suspension plate with the toilet seat lid while the step suspension plate is in its first position; and further comprising third removable attaching means fixedly attached to the upper surface of the step plate and to the lower surface of the step suspension plate, the third removable attaching means further interlinking the step plate with the step suspension plate while the step plate is in its first position; each of the first, second, and third removable attaching means comprising a magnet.

* * * * *